United States Patent [19]

Fujisawa

[11] Patent Number: 4,568,276

[45] Date of Patent: Feb. 4, 1986

[54] DUST PREHEATING SYSTEM WITH INCIPIENT CALCINER

[75] Inventor: Tetsuo Fujisawa, Kobe, Japan

[73] Assignee: Kabushiki Kaisha Kobe Seiko Sho, Kobe, Japan

[21] Appl. No.: 690,509

[22] Filed: Jan. 11, 1985

[30] Foreign Application Priority Data

| | | | |
|---|---|---|---|
| Feb. 15, 1984 | [JP] | Japan | 59-27936 |
| May 30, 1984 | [JP] | Japan | 59-110130 |
| Sep. 7, 1984 | [JP] | Japan | 59-188394 |

[51] Int. Cl.[4] ..... F27B 7/08

[52] U.S. Cl. ..... 432/106; 432/14; 106/100

[58] Field of Search ..... 432/14, 58, 106; 106/100

[56] References Cited

U.S. PATENT DOCUMENTS

| | | | |
|---|---|---|---|
| 3,881,861 | 5/1975 | Ritzmann | 432/106 |
| 3,881,862 | 5/1975 | Nishida et al. | 432/106 |
| 4,326,845 | 4/1982 | Hess | 432/106 |
| 4,402,667 | 9/1983 | Goldmann | 432/106 |
| 4,427,377 | 1/1984 | Dambrine et al. | 106/100 |
| 4,470,849 | 9/1984 | Abelitis et al. | 432/14 |

FOREIGN PATENT DOCUMENTS

| | | |
|---|---|---|
| 55105643 | 8/1980 | Japan |
| 5734054 | 2/1982 | Japan . |

*Primary Examiner*—Henry C. Yuen

*Attorney, Agent, or Firm*—Oblon, Fisher, Spivak, McClelland & Maier

[57] ABSTRACT

A dust preheating system with an incipient calcinating furnace for powdery material, including a combustion furnace, a clinker cooler located on a downstream side of the combustion furnace, a preheater having a plurality of dust separators connected in series in a vertical direction to form a corresponding number of preheating stages, an incipient calcination furnace located between said preheater and said combustion furnace when seen in a flow direction of said powdery material and connected through a combustion air duct to the clinker cooler, the incipient calcination furnace including an independent fuel feeder and connected through a combustion gas duct to a lowermost dust separator of the plurality of dust separators for calcined material, a second lowest dust separator of the preheater having a dust outlet thereof connected to the incipent calcination furnace, and the lowermost dust separator having a calcined dust outlet connected to an inlet of the combustion furnace, wherein the second lowest dust separator includes a cyclone separator provided with an opening in a side wall thereof and having a fine dust outlet in a lower portion thereof, and a coarse dust separating pocket hermetically connected to the opening and having a coarse dust outlet in a lower portion thereof and a mechanism connecting the fine and coarse dust outlets to fine and coarse dust feed ports provided at spaced portions in a side wall of the incipient calcination furnace.

12 Claims, 12 Drawing Figures

DUST PREHEATING SYSTEM WITH INCIPIENT CALCINER

BACKGROUND OF THE INVENTION

1. Field of the Invention

This invention relates to a preheating system with an incipient calciner suitable for preheating and incipient calcination of raw materials of cement, alumina, lime stone and the like, and more particularly to a dust preheating system with an incipient calcination furnace which can realize improvements of performance quality in both the combustion of a fuel and incipient calcination of the dust of a raw material in the incipient calcination furnace.

2. Description of the Prior Art

FIG. 1 shows a flowchart of an exemplary dust burning system for raw materials of cement, in which arrows of solid line indicate a flow direction of gases and arrows of broken line indicate a flow direction of raw material dust.

This system is mainly composed of a preheater/incipient calciner 1 consisting of dust separators C1 to C4 in the form of cyclones or the like and an incipient calcination furnace 2, a main combustion furnace 3 in the form of a rotary kiln or the like, and a clinker cooler 4. The powdery raw material which is fed through a chute 5 successively flow down through the first to third stage cyclones C1 to C3, while hot exhaust gases from the combustion furnace 3 and the incipient calcination furnace 2 are sucked by an induced draft fan 8, flowing up through the preheater 1. Therefore, heat exchange between the powdery raw material and hot gas is repeated in the duct 7 and cyclones C1 to C3. The preheated powdery raw material is fed to the incipient calcination furnace 2 through a chute 14 from cyclone C3 of the second lowest stage of the preheater 1.

On the other hand, combustion takes place in the incipient calcination furnace 2 which receives hot secondary combustion air from the clinker cooler 4 through a combustion air duct 13 in addition to the supply of a fuel and primary combustion air from a burner 6*a*. By the heat of this combustion and of the exhaust gases from the combustion furnace 3, the powdery raw material which is charged through the chute 14 is preliminarily calcined. The powdery raw material which has undergone the incipient calcination through the incipient calcination furance 2 is fed to the lowermost cyclone C4 along with the combustion exhaust gas, where the dust is separated from the combustion gas and sent to the combustion furnace 3 through the chute 15. The powdery material is subjected to a necessary heat treatment in the combustion furnace 3 and formed into clinker by the heat resulting from combustion of a fuel which is supplied by a burner 6*b* located at the end of the furnace 3, discharging the clinker to the cooler 4 for cooling.

The clinker cooling air is supplied by a forced draft fan 10 and part of hot air resulting from heat exchange with the clinker is circulated to the incipient calcination furnace 2 and combustion furnace 3, discharging excess air by the inducing draft fan 9. The clinker which is discharged from the clinker cooler 4 is transferred to a next processing stage by a conveying means 11.

FIG. 2 is a schematic illustration showing details of the preheater arrangement in the vicinity of the incipient calcination furnace, which is employed for the explanation of the construction and functions of the incipient calcination furnace.

Namely, in the particular example shown, the incipient calcination furnace 2 is the form of an upright cylinder, which is provided with a combustion chamber 2*a* and a mixing chamber 2*b* on the lower and upper sides of a constricted orifice portion 2*c*. The lower end of the combustion chamber 2*a* is formed in an inverted truncated-cone shape with its sectional area gradually reduced in the downward direction, terminating in an opening 2*d* which is connected to the combustion furnace 3 through an end cover 12. A combustion air duct 13 which guides the combustion air from the clinker cooler 4 is radially or tangentially connected to an inlet port 2*e* provided in a lower portion of the side wall of the combustion chamber 2*a*, and a burner 6*a* which supplies a fuel is embedded in a position proximate to the junction of the ceiling wall of the combustion air duct 13 and the side wall of the combustion chamber 2*a* of the incipient calcination furnace 2, directing the burner 6*a* toward the hot combustion air which is drawn into the combustion chamber 2*a*. Further, a chute 14 for the preheated material from the cyclone C3 in the second lowest stage of the preheater 1 is connected to a position above the burner 6*a*, and directed toward a combustion zone 16 which is formed in the combustion chamber 2*a* by the fuel supplied from the burner 6*a*. On the other hand, a combustion gas outlet 2*f* of the mixing chamber 2*b* is connected to the cyclone C4 in the final stage of the preheater 1.

In operation, the preheated material dust from the cyclone C3, the second one from the lowest, of the preheater 1 is fed into the combustion chamber 2*a* of the incipient calcination furnace 2 through the chute 14, and mixed and stirred in the combustion chamber 2*a* by ascending exhaust gas from the combustion furnace 3, forming fluidized gas streams. The combustion air which is drawn from the clinker cooler 4 is introduced into the fluidized gas streams through the combustion air duct 13, while a fuel is supplied from the burner 6*a* above the air supply port 2*e* through which the combustion air duct 13 is opened into the combustion chamber 2*a*, thereby effecting combustion in the fluidized gas streams.

Accordingly, the powdery raw material which is fed into the combustion chamber 2*a* through the preheated dust chute 14 undergoes reactions of incipient calcination by absorption of the heat resulting from combustion of the fuel and the sensible heat of the exhaust gas from the combustion furnace 3, passing through the constricted orifice portion 2*c* along with the combustion gas, and then admitted into the mixing chamber 2*b*. After completely burning combustible components of the combustion gas in the mixing chamber 2*b*, the material is discharged into the cyclone C4 in the lowermost stage of the preheater 1 through the opening 2*f*.

For burning the fuel in the incipient calcination chamber in the above-described manner, the burner 6*a* is mounted in such a manner as to be directed toward the hot air flowing into the combustion chamber 2*a*, for effecting the combustion in as good a condition as possible.

In a case where the preheating raw material is thrown toward the combustion zone 16 in the combustion chamber 2*a* from the second lowest cyclone C3 of the preheating section 1 which supplies the preheating raw material to the incipient calcination furnace, as shown in FIGS. 1 and 2, there is an advantage in that the reactions of incipient calcination can be accelerated since the powdery raw material is promptly heated to a high temperature in the combustion zone. However, such increases the concentration of the powdery raw material in the combustion zone 16, consequently lowering the combustion temperature in the combustion zone 16 and resulting in an unsatisfactory quality of combustion.

On the other hand, in a case where the preheating dust chute which supplies the incipient calcination furnace 2 with the preheating raw material from the second lowest cyclone C3 of the preheating section 1 is connected at a position distant from the combustion zone 16 in the combustion chamber 2*a* to the circumferential direction in cross section of the incipient calcination furnace 2, namely, to a position 14' indicated by broken line in FIG. 2, the concentration of the powdery raw material in the combustion zone 16 becomes relatively lean and the quality of combustion of the fuel is improved by a temperature elevation in the combustion zone 16. However, since the heating of the powdery raw material in the combustion chamber 2*a* becomes slower, the incipient calcination reactions proceed at a lower velocity, resulting in an inferior incipient calcination quality and production of an increased amount of NOx (nitrogen oxides) due to the temperature elevation in the combustion zone 16.

Under these circumstances, the present inventor previously proposed a dust preheating system with an incipient calcination furnace in which, as disclosed in Japanese Patent Application No. 55-105643 (see Laid-Open Patent Application No. 57-34054), the preheating material to be fed to the incipient calcination furnace is divided into two parts, one part being fed to the combustion zone and the other part being directed away from the combustion zone and toward the exhaust gas which flows into the incipient calcination furnace from the combustion furnace, thereby adjusting the temperature of the combustion atmosphere for improving the incipient calcination quality and suppressing the production of NOx while maintaining satisfactory combustion quality. In this previously proposed system, the powdery raw material undergoes the incipient calcination reactions to a sufficient degree with regard to the part which is fed to the combustion zone, but not the other part which is fed to a region remote from the combustion zone. Thus, such still needs improvements in overall incipient calcination quality.

SUMMARY OF THE INVENTION

It is an object of the present invention to provide a dust preheating system with an incipient calcination furnace which can overcome the above-mentioned drawbacks or difficulties of the prior art, namely, a dust preheating system which can improve the incipient calcination quality of a powdery raw material while maintaining a satisfactory combustion quality of a fuel in an incipient calcination furnace.

It is another object of the present invention to provide a dust preheating system with an incipient calcination furnace, which can calcine powdery material with a high efficiency even when a solid fuel like granulated coal is used.

It is a further object of the present invention to provide a dust preheating system with an incipient calcination furnace, which can accelerate decarbonization of powdery raw material irrespective of the grain size or grain size distribution of the raw material.

In order to achieve the foregoing objectives, the present invention provides a dust preheating system with an incipient calcination furnace, including a preheater having a plurality of dust separators connected in series in a vertical direction to form a corresponding number of preheating stages, an incipient calcination furnace located between the preheater and a combustion furnace when seen in the flow direction of a powdery raw material being fed and connected through a combustion air duct to a clinker cooler located on the downstream side of the combustion furnace, the incipient calcination furnace being provided with an independent fuel feeder and connected through a combustion gas duct to the lowermost dust separator for calcined material, the second lowest dust separator of the preheater having the dust outlet thereof connected to the incipient calcination furnace, and the lowermost dust separator having a calcined dust outlet connected to an inlet of the combustion furnace, characterized in that at least the second lowest dust separator is constituted by a cyclone separator having an opening in the side wall thereof and provided with a fine dust outlet in a lower portion thereof, and a coarse dust separating pocket hermetically connected to the opening and having a coarse dust outlet in a lower portion thereof, the fine and coarse dust outlets being connected to fine and coarse dust feed ports formed at spaced positions in the side wall of the incipient calcination furnace.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 3:
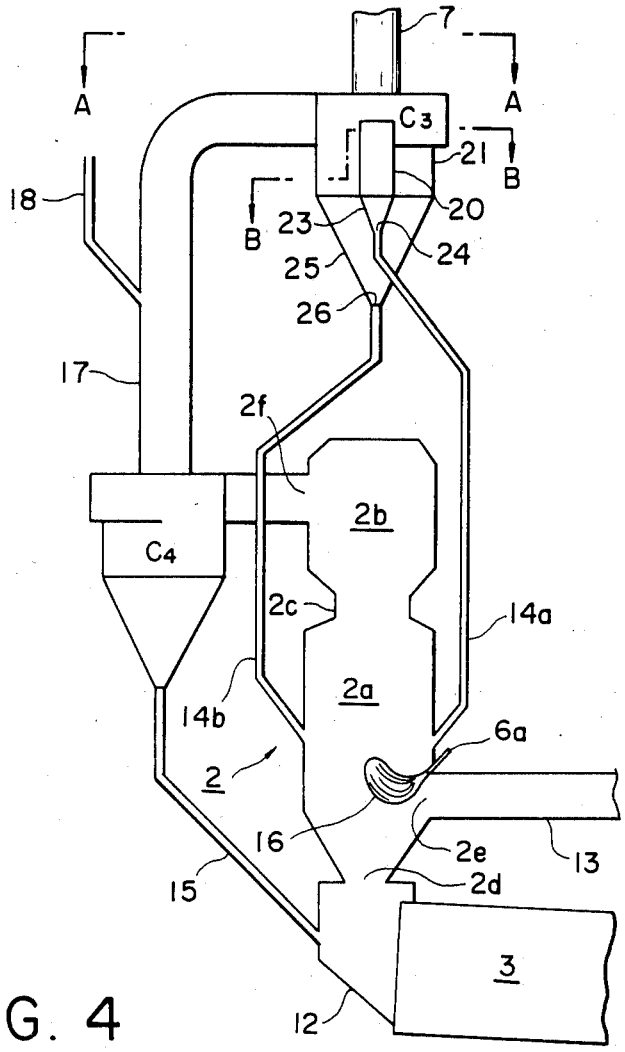
FIG. 3 is a schematic illustration showing the construction of a preheating system including an incipient calcination furnace in one embodiment of the present invention.

Hereafter, the invention is described more particularly by way of the preferred embodiments shown in FIG. 3 and subsequent Figures. However, it is to be understood that the invention is not limited to the specific arrangements shown and it is possible to employ other arrangements or to add modifications or alterations thereto without departing from the spirit and scope of the invention.

Figure 1:
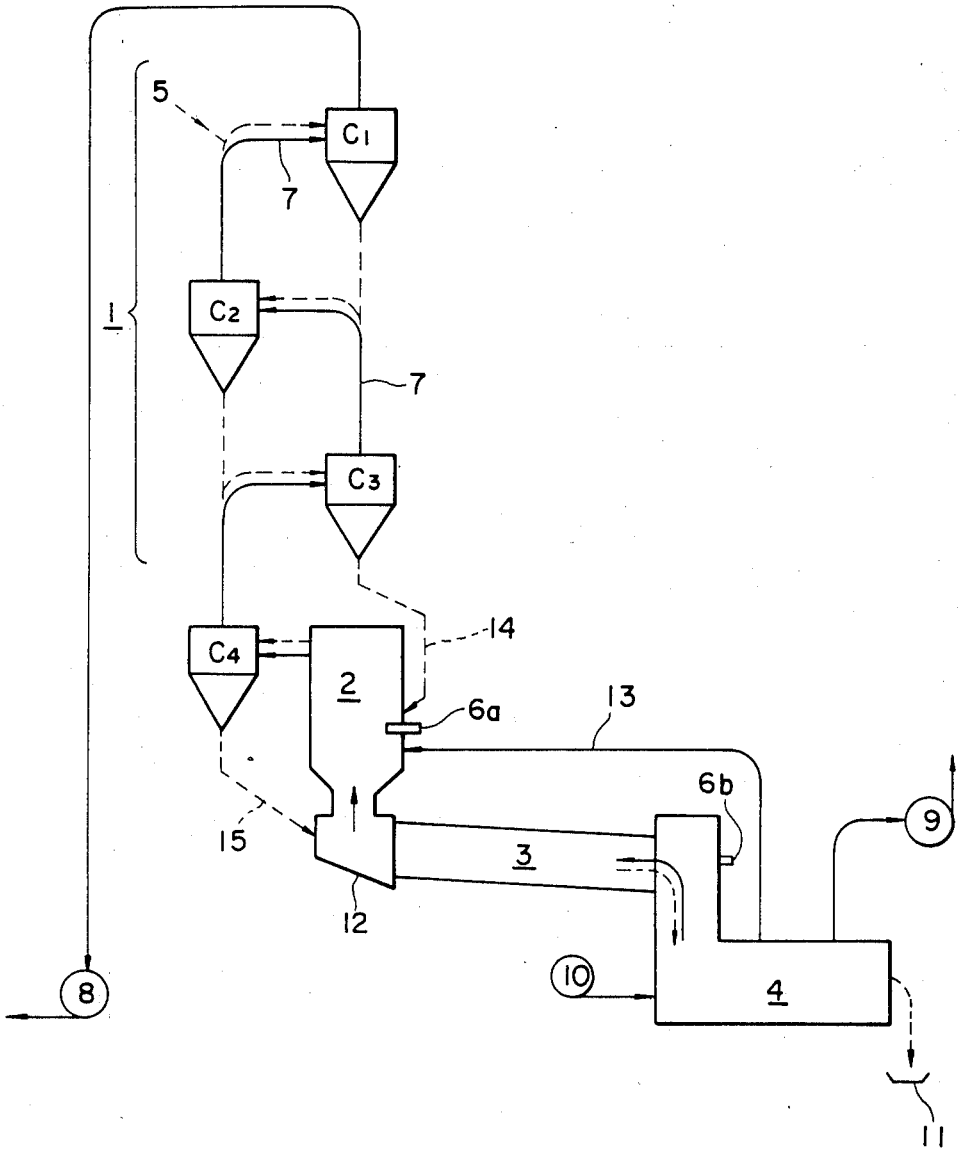
FIG. 1 PRIOR ART
FIG. 1 is a schematic illustration of a typical conventional system for burning powdery raw materials of cement.
Figure 2:
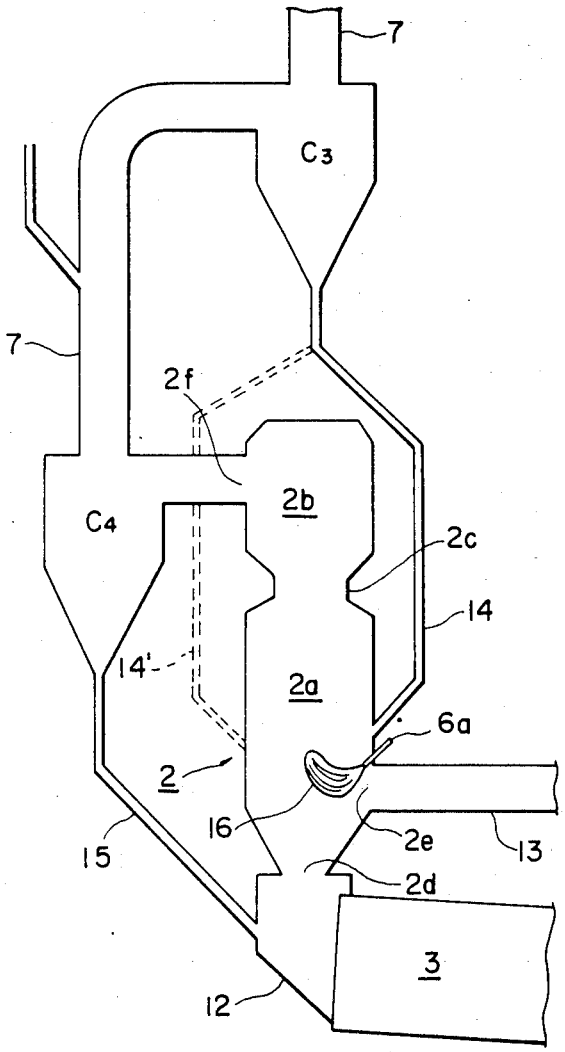
FIG. 2 is a schematic illustration of a preheating section of the burning system in FIG. 1, including an incipient calcination furnace.

Referring to FIG. 3, there is schematically shown the arrangement of a dust preheating system with an incipient calcination furnace, embodying the present invention, which is almost the same as the conventional preheating system of FIG. 2 with regard to the basic construction of the incipient calcination furnace 2, the manner in which the exhaust gas from a combustion furnace 3 is introduced into the incipient calcination furnace, the manner of supplying combustion air through the combustion air duct 13, the flow of the combustion gas in the incipient calcination furnace 2, and the manner of discharging the combustion gas from the incipient combustion furnace 2.

Figure 4:
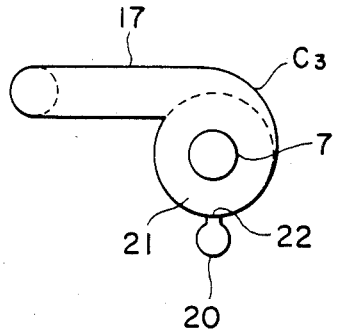
FIG. 4 is a schematic plan view of the second lowest dust separator of the preheating system as seen in the arrowed direction A—A in FIG. 3.
Figure 5:
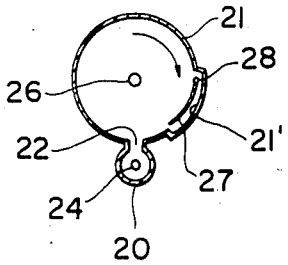
FIG. 5 is a schematic cross-sectional view of the same dust separator as seen in the arrowed direction B—B in FIG. 3.

Referring to FIGS. 3 to 5, the description is directed to the details of the first embodiment to explain its features in construction. The second lowest dust separator C3 of the preheating system, which supplies a preheating raw material to an incipient calcination furnace 2, includes a fine dust separating means consisting of, for example, a cyclone 21 having an opening 22 in the side wall thereof, and a coarse dust separating means consisting of a pocket 20 fixed to the side wall of the cyclone 21 in communication with the opening 22 and having a coarse dust discharge port 24 at the bottom of a lower pocket portion 23 of an inverted truncated-cone shape. The dust discharge port 24 of the pocket portion 20 is connected through a coarse dust chute 14*a* to a combustion chamber 2*a* at a position close to an air feed port 2*e* and immediately above a fuel feeder 6*a*, in such a manner as to direct the coarse dust toward a combustion zone 16. On the other hand, a fine dust discharge port 26 of the cyclone 21 is connected to a fine dust chute 14*b* opening into the combustion chamber 2*a* at a position which is shifted in a circumferential direction to be remote from the fuel feeder 6*a* in a cross section of the combustion chamber 2*a*.

With the foregoing arrangement, the powdery raw material which is collected by the upper dust separator of the preheater is fed to the gas duct 17 through the dust chute 18 and then introduced into the intermediate stage cyclone C3, entrained on the hot gas streams discharged from the lowermost cyclone C4. While being whirled around the cylindrical inner wall by the vortex which is generated in the dust separator C3, relatively large particles of the powder material are thrown into the pocket housing 20 through the opening 22 under the influence of the centrifugal force, and sent further through the dust discharge port 24 of the pocket housing 20 and the coarse dust chute 14*a* toward the combustion zone 16 formed in the combustion chamber 2*a*. On the other hand, fine particles which cannot be trapped in the pocket housing 20 are entrained on the vortex gas streams, flowing further down along the inner surface of the inverted conical portion 25 of the cyclone 21, and are fed through the fine dust chute 14*b* into the incipient calcination furnace 2 at a point remote from the combustion zone 16. In this instance, the proportions of fine and coarse particles to be separated by the cyclone C3 can be adjusted by a suitable adjusting means, for example, by a distributor plate 27 which is located in a recess 21′ on the upstream side of the opening 22 and rotatable about a shaft 28.

Accordingly, only a part of the powdery raw material to be fed to the incipient calcination furnace 2 is thrown into the combustion zone 16, which is formed in the combustion chamber 2*a*, and its proportion can be adjusted so that it becomes possible to maintain the combustion atmosphere in the zone 16 at a suitable high temperature and to suppress the production of NOx. Besides, although the preheated material which is fed to the combustion zone in the above-described manner mostly consists of coarse particles which are less susceptible to the incipient calcination reactions, such can be calcined at a high reaction velocity in the combustion zone of a relatively high temperature.

On the other hand, the fine dust which is fed to a region remote from the combustion zone 16 undergoes the incipient calcination by relatively slow heating, completing uniform incipient calcination reactions irrespective of its particle size before it is discharged to the lowermost cyclone C4 from the mixing chamber 2*b* of the incipient calcination furnace 2. Thus, the quality of incipient calcination as a whole can be improved to a considerable degree, producing satisfactory results both in terms of combustion and incipient calcination qualities.

The pocket-attached cyclone which is integrally provided with a coarse dust separator and a fine dust separator structurally has an advantage in that the use of a pocket housing of a compact construction as a coarse dust separator provides broad freedom in terms of in design with regard to its position in the circumferential direction of the cyclone, in addition to functional advantages such as high separation efficiency and suppression of excessive pressure losses. It is therefore suitable for use as a second lowest dust separator in the preheating system of the invention.

Figure 6:
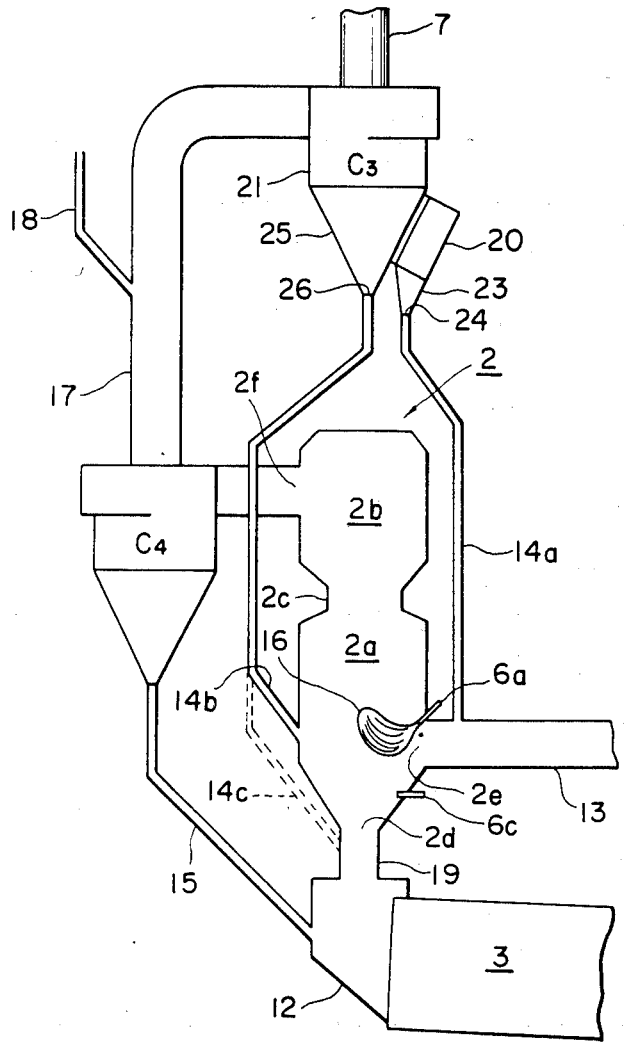
FIG. 6 is a view similar to FIG. 3 but showing another embodiment of the invention.

Shown schematically in FIG. 6 is a modified system around the incipient calcination furnace in another embodiment of the invention, which differs from the foregoing first embodiment in the following points.

As illustrated, a pocket 20 which constitutes a coarse particle separating means for a second lowest dust separator C3 of the preheating system 1 is provided on an inverted truncated-conical portion 25 serving as a fine particle separating means of the cyclone 21. In this manner, it is possible to adjust the amount and the particle size distribution of the separating fraction by selecting the height of the pocket 20 on the cylindrical or inverted truncated-conical portion of the cyclone 21.

The coarse particles of the preheating raw material trapped in the pocket 20 are fed to the combustion air duct 13 through a coarse dust chute 14*a* and introduced into a combustion zone 16 in a combustion chamber 2*a* along with combustion air. A dust supply means which is adapted to feed coarse particles by combustion air in this manner is capable of dispersing the coarse particles relatively uniformly over the combustion zone 16, coupled with an advantage of uniformalizing the temperature distribution in the combustion zone.

On the other hand, fine particles which are collected by the cyclone 21 are passed through a fine dust chute 14*b* and introduced into the incipient calcination furnace toward the exhaust gas from the combustion furnace 3, from a position in the vicinity of the inverted truncated-conical portion at the lower end of the incipient calcination furnace. Accordingly, this is effective for an abrupt temperature drop of the combustion furnace exhaust which flows into the incipient calcination furnace. As indicated in phantom lines, the fine dust may be fed to an exhaust gas duct 19 through a fine dust chute 14*c* or directly to an inverted truncated-conical portion at the lower end of the incipient calcination furnace. In any case, the fine dust is easily fluidized by the exhaust gas from the combustion furnace 3, and prevented from dropping directly into the end cover 12 in a shortcircuiting fashion. In a case where a fuel feeder 6*c* is additionally provided in the side wall of the inverted truncated-conical portion to form a reducing gas atmosphere in the inverted conical portion for the purpose of decomposing NOx components of the combustion exhaust gas flowing up from the gas inlet port 2*d* at the lower end, the catalytic effect of the powdery raw material which acts as a denitration catalyst is increased due to the large contact area of the fine particles.

In the practice of the present invention, the construction of the incipient calcination furnace, the number of the combustion air ducts, and the type, number and location of the fuel feeder may be arbitrarily selected depending upon the kind of the powdery raw material to be processed.

Figure 7:
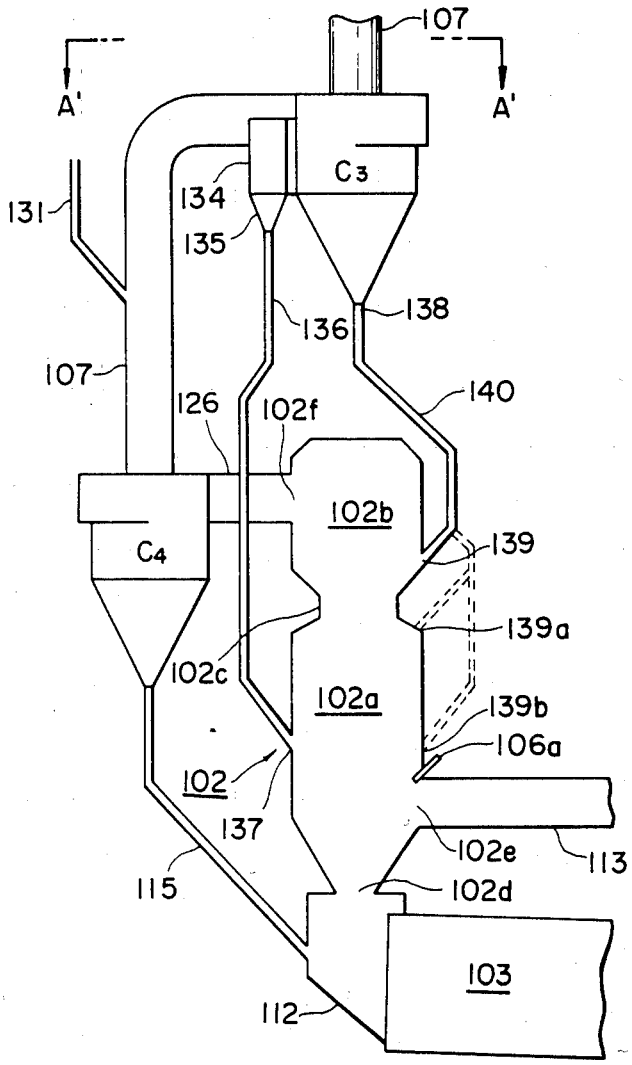
FIG. 7 is a schematic illustration of a modification of the preheating system of the invention.
Figure 8:
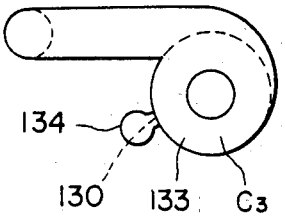
FIG. 8 is a sectional view taken on line A'—A' of FIG. 7.

Referring to FIGS. 7 and 8, there is shown a modification in which a coarse dust chute 136 extending from the lower end of a pocket housing 134 on the second lowest cyclone C3 is connected to a coarse dust feed port 137 which is provided in the side wall of the combustion chamber 102*a* of the incipient calcination furnace 102. On the other hand, a fine dust chute 140 extending from the fine dust discharge port 138 at the lower end of the cyclone C3 is connected to a fine dust feed port 139 provided in the side wall of the mixing chamber 102*b* of the incipient calcination furnace 102. If desired, the fine dust chute 140 may be connected to a plurality of fine dust feed ports 139, 139*a*, 139*b* and so forth which are provided in the side wall of the incipient calcination furnace 102 at intervals along the flow direction as indicted by broken line in FIG. 7. In such case, at least one of the fine dust inlet ports is preferred to be located on the downstream side of the coarse dust feed port 137.

The combustion chamber 102*a* which is supplied with coarse dust is not susceptible to coating of the powdery material on its side wall, so that it is possible to raise the temperature of the atmosphere gas in the combustion chamber 102*a* to thereby accelerate incipient calcination reactions of coarse particles as an exponential function of the absolute temperature. The temperture in the combustion chamber 102*a* can also be adjusted by feeding part of the fine dust in the chute 140 to the combustion chamber 102*a*.

Figure 9:
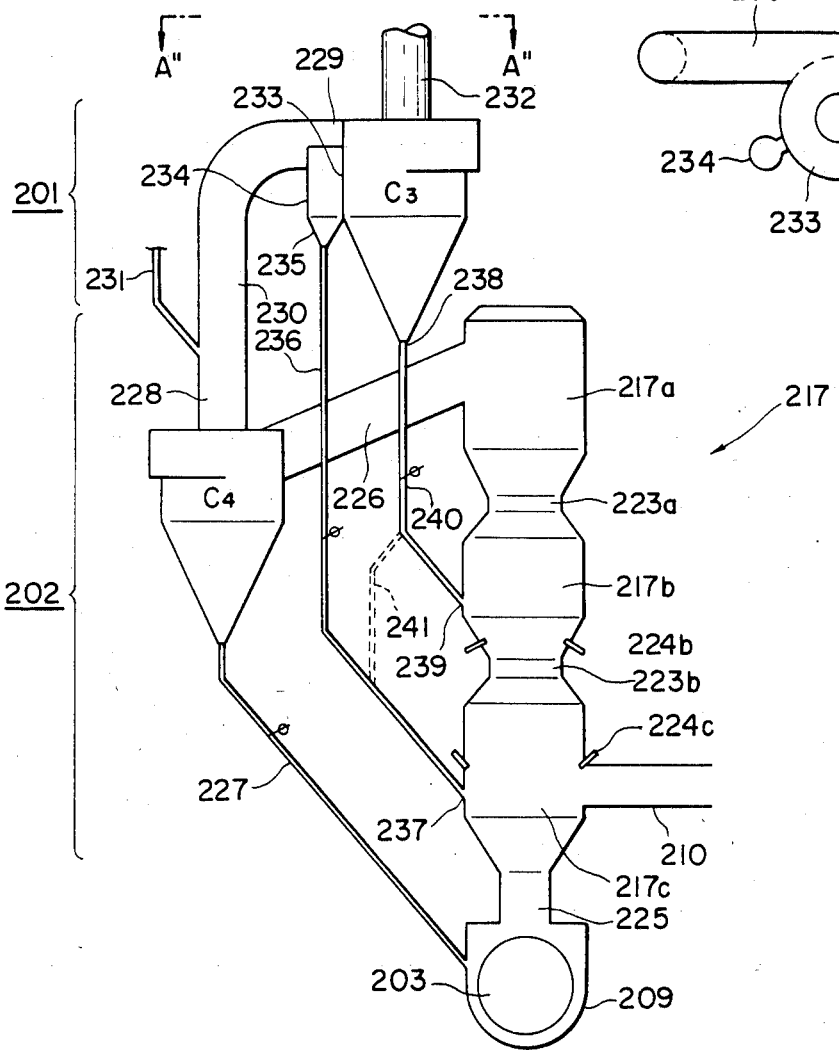
FIG. 9 is a schematic illustration of another embodiment of the invention.
Figure 10:
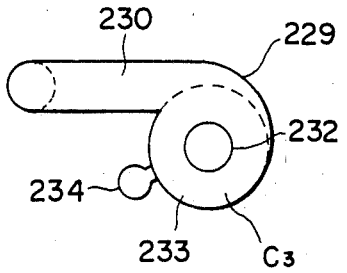
FIG. 10 is a sectional view taken on line A"—A" of FIG. 9.

Referring to FIGS. 9 and 10, there is shown a further embodiment of the invention, employing an incipient calcination furnace 217 which is provided with a couple of constricted orifice portions 223*a* and 223*b* defining a mixing chamber 217*a*, an upper calcination chamber 217*b* and a lower calcination chamber 217*c*, each having a bottom in the shape of an inverted truncatedcone. The upper and lower calcination chambers 217*b* and 217*c* are respectively provided with fuel feeders 224*b* and 224*c*, independently forming an incipient calcination zone. The calcination furnace 217 is located as a whole over the inlet end cover 209 of the combustion furnace 203, and communicated with the inlet end cover 209 through the exhaust gas induction duct 225. In the same manner as in the foregoing embodiments, the uppermost mixing chamber 217*a* of the calcination furnace 217 is connected to a lowermost dust separator C4 which serves as a separator for calcined material and which has its dust discharge port connected to the combustion furnace 203 through a chute 227 and the end cover 209.

A pocket-like coarse dust separator 234 which is provided on the second lowest dust separator C3 has the same construction as in the foregoing embodiment and is connected to a coarse particle feed port 237 in the side wall of the lower calcination chamber 217*c* through a coarse dust chute 236. The fine dust outlet 238 of the dust separator C3 is connected to a fine particle feed port 239 through a fine dust chute 240. If necessary, the fine and coarse dust chutes 240 and 236 may be intercommunicated through a branch chute 241 as indicated in phantom.

The combustion air which is extracted from the clinker cooler is entirely supplied to the lower calcination chamber 217*c* through the combustion air duct 210 as in the foregoing embodiments. Accordingly, the exhaust gas from the combustion furnace 203 and hot air from the clinker cooler which are introduced into the lower calcination chamber 217*c* through the exhaust gas duct 225 and combustion air duct 210 form a spouted bed of the powdery material flowing through the upper calcination chamber 217*b* and mixing chamber 217*a* and through the combustion gas duct 226 into the dust separator C4, forming vorticies therein. Then, the combustion gas is discharged into the upper dust separator C2 through C3. On the other hand, the powdery material which is collected by the upper dust separator C2 is fed to the gas duct 230 through the chute 231 and introduced into the dust separator C3, entrained in the combustion exhaust gas. In the dust separator C3, coarse particles of the powdery material are thrown into the pocket 234 and fed to the lower calcination chamber 217*c* through the coarse dust chute 236, while fine particles which have not been trapped in the pocket 234 are entrained in the vortice, flowing down along the inner surface of the inverted truncated-conical portion of the dust separator C3, and introduced into the upper calcination chamber 217*b* through the fine dust outlet 238 and fine dust chute 240.

On the other hand, as described hereinbefore, the entire amount of combustion air from the clinker cooler is supplied to the lower calcination chamber 217*c*, and carbon dioxide which is produced by the fuel and raw material in the upper calcination chamber 217*b* does not flow into the lower calcination chamber 217*c*. Therefore, it becomes possible to reduce the partial pressure of carbon dioxide of the hot gas in the lower calcination chamber 217*c*, and thus to calcine at a high reaction velocity the coarse dust which is fed to the lower calcination chamber 217*c*. Accordingly, the calcination reactions of the coarse dust which is fed to the lower calcination chamber 217*c* proceed to a sufficient degree before it is carried into the upper calcination chamber 217*b* by the hot gas to undergo calcination there again together with fine dust. Calcination of fine dust is relatively easy, so that it can be calcined in a short time period even in a hot gas with a high carbon dioxide concentration. Thus, the calcination reactions of the powdery raw material can be almost completed in the lower and upper calcination chambers.

The calcined material which has undergone sufficient calcination in the above-described manner is then fed through the combustion gas duct 226 into the dust separator C4, where the material is swirled and fed downward, under the influence of the centrifugal force resulting from the swirling action, to the chute 227 connected to the lower end of the dust separator C4 and to the combustion furnace 203 via end cover 209.

With the foregoing system arrangement, the temperatures in the lower and upper calcination chambers 217*c* and 217*b* can be adjusted arbitrarily according to the amount of the fuel and/or raw material to be fed into the respective chambers. In this instance, the lower calcination chamber 217*c* which is supplied with coarse dust is not susceptible to coating of the powdery material on its side wall, so that it becomes possible to raise the atmosphere gas temperature in that chamber to a level higher than in the upper calcination chamber 217*b* to increase the velocity of calcination reactions of the coarse powder as an exponential function of the absolute temperature.

As mentioned hereinbefore, part of the fine dust may be supplied to the lower calcination chamber 217*c* through the chute 241 depending upon the temperature condition to thereby raise the combustion load in the lower calcination chamber 217*c* or on the contrary to drop the combustion load in the upper calcination chamber 217*b*.

Figure 11:
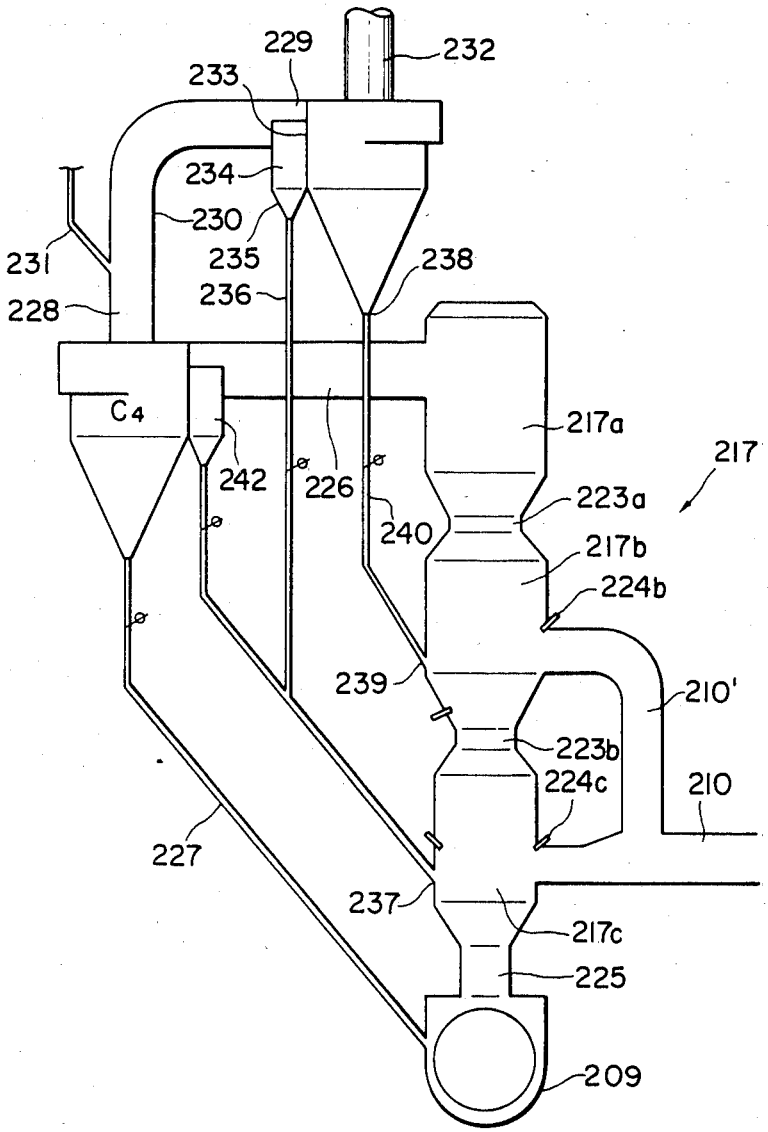
FIG. 11 is a schematic illustration of a modification of the embodiment shown in FIG. 9.

Shown in FIG. 11 is a modification which differs from the embodiment of FIG. 9 in that the dust separator C4 which is connected to the mixing chamber 217*a* through the combustion gas duct 226 is also provided with a pocket-like coarse dust separator 242 and in that part of the hot air which is extracted from the clinker cooler through the combustion air duct 210 is supplied to the upper calcination chamber 217*b* through a branch duct 210'.

The coarse dust separator 242 on the cyclone C4 separates coarse particles which are not relatively susceptible to calcination reactions, from the powdery material which has undergone calcination reactions to a substantial degree in the calcination furnace 217, and recirculates the same to the lower calcination chamber 217*c* to thereby accelerate the calcination reactions all the more.

When part of the hot air from the cooler is short-circuited to the upper calcination chamber 217*b* in this manner, the partial pressure of carbon dioxide in the hot gas in the lower calcination chamber 217*c* is increased slightly depending upon the air short-circuiting rate. However, due to a drop of the gas flow rate through the lower calcination chamber 217*c*, it becomes possible to reduce the sectional area of the lower calcination chamber 271*c*. In this case, the branch duct 210' is preferred to be provided with a damper (not shown) or the like which controls the flow rates of hot air to the upper and lower calcination chambers 217*b* and 217*c* for adjusting the carbon dioxide concentration in the lower calcination chamber 217*c*.

Although the incipient calcination furnace 217 is erected on the end cover 209 of the combustion furnace 203 and the exhaust gas from the furnace 203 is introduced into the lower calcination chamber 217*c* through the bottom end thereof as a fluidizing gas in the foregoing embodiments, the hot combustion air from the clinker cooler may be used for the formation of the drifting fluidized bed instead of the exhaust gas from the combustion furnace 203. In such case, the exhaust gas from the combustion furnace 203 is treated separately or directly introduced into the upper calcination chamber 217*b*. In any event, the arrangement in which the lower calcination chamber 217*c* is free of the furnace exhaust gas which contains carbon dioxide in a relatively high concentration permits lowering of the partial pressure of carbon dioxide in the lower calcination chamber 217*c* and therefor acceleration of the incipient calcination of the coarse dust even further.

Figure 12:
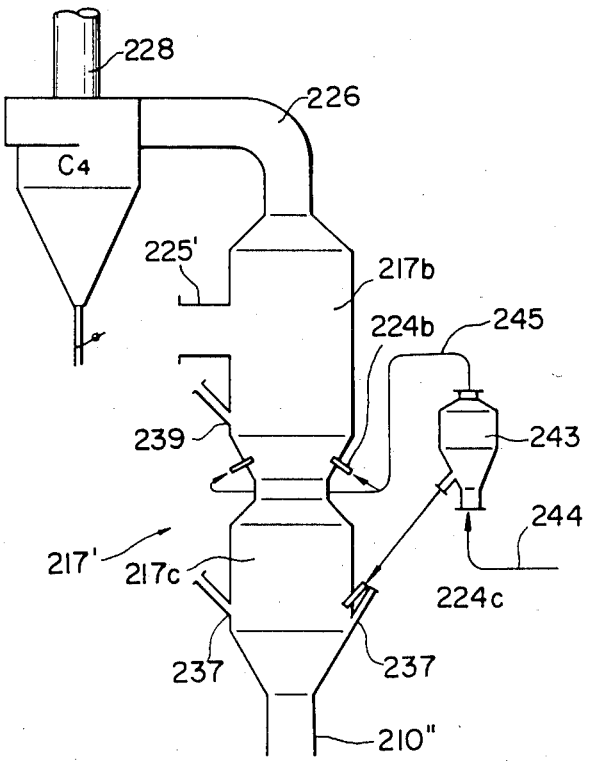
FIG. 12 is a schematic illustration of still another embodiment of the invention.

In the embodiment of FIG. 12, the combustion air duct 210' is connected to the lower end of the incipient calcination furnace 217' to blow into the lower calcination chamber 217*c* the hot combustion air from the clinker cooler as a fluidizing gas, and an exhaust gas duct 225' is connected to the upper calcination chamber 217*b* to introduce thereinto the furnace exhaust gas.

Further, the preheating system of FIG. 12 includes a fuel classifier 243 which is connected to the fuel feeders 224*b* and 224*c* for classifying granulated coal or other solid fuel to be supplied thereto. In the particular embodiment shown in FIG. 12, a solid fuel which is pneumatically transferred through a pipe 244 is classified by the fuel classifier 243, entraining fine dust of the fuel on the carrier air for supply to the fuel feeder 224*b* of the upper calcination chamber 217*b*, while supplying coarse dust of the fuel to the fuel feeder 224*c* of the lower calcination chamber 217*c* by gravity.

In the present embodiment, the combustion air which is used in the upper calcination chamber 217*b* is also admitted into the lower calcination chamber 217*c*, so that the combustion atmosphere in the lower calcination chamber 217*c* contains oxygen in a high concentration. Besides, as mentioned hereinbefore, the temperature in the lower calcination chamber 217*c* can be raised by adjusting the feed rate of the fuel and/or raw material to the lower calcination chamber 217*c*. Accordingly, the coarse fuel can be burned to a substantial degree in the lower calcination chamber 217*c*, and remaining combustible components flow into the upper calcination chamber 217*b* together with the combustion gas and completely burned there.

What is claimed is:

1. A dust preheating system with an incipient calcination furnace for powdery material, comprising:

a combustion furnace;

a clinker cooler located on a downstream side of said combustion furnace;

a preheater having a plurality of dust separators connected in series in a vertical direction to form a corresponding number of preheating stages;

an incipient calcination furnace located between said preheater and said combustion furnace when seen in a flow direction of said powdery material and connected through a combustion air duct to said clinker cooler, said incipient calcination furnace including an independent fuel feeder and connected through a combustion gas duct to a lowermost dust separator of said plurality of duct separators for calcined material, a second lowest dust separator of said preheater having a dust outlet thereof connected to said incipient calcination furnace, and said lowermost dust separator having calcined dust outlet connected to an inlet of said combustion furnace, wherein said second lowest dust separator further comprises a cyclone separator provided with an opening in a side wall thereof and having a fine dust outlet in a lower portion thereof, and a coarse dust separating pocket hermetically connected to said opening and having a coarse dust outlet in a lower portion thereof; and means for connecting said fine and coarse dust outlets to fine and coarse dust feed ports provided at spaced positions in a side wall of said incipient calcination furnace.

2. A preheating system as set forth in claim 1, wherein said coarse dust feed port is so positioned as to pass the coarse dust through a relatively high temperature zone of said calcination furnace, and said fine dust feed port is so positioned as to pass the fine dust through a relatively low temperature zone of said calcination furnace.

3. A preheating system as set forth in claim 1, wherein said coarse dust feed port is located at a position close to said fuel feeder, and said fine dust feed port is located at a position remote from said fuel feeder.

4. A preheating system as set forth in claim 1, wherein said coarse dust feed port is located upstream of said fine dust feed port as seen in a flow direction of gases in said incipient calcination furnace.

5. A preheating system as set forth in claim 1, wherein said coarse dust feed port is provided in said combustion air duct connected to said incipient calcination furnace.

6. A preheating system as set forth in claim 1, wherein said incipient calcination furnace further comprises a fluidizing vessel with a lower portion of an inverted conical shape and having an opening at a lower end thereof in communication with said combustion furnace.

7. A preheating system as set forth in claim 6, wherein said incipient calcination furnace further comprises a series of fluidizing vessels stacked in a vertical direction and each having a lower portion of an inverted conical shape, and wherein said combustion air duct is connected to the lowest one of said fluidizing vessels.

8. A preheating system as set forth in claim 7, wherein said coarse and fine dust feed ports are provided in the side walls of the lowest and the second lowest fluidizing vessels of said incipient calcination furnace.

9. A preheating system as set forth in claim 8, wherein said fuel feeder is provided in a lowest and second lowest fluidizing vessel of said incipient calcination furnace.

10. A preheating system as set forth in claim 9, further comprising means for connecting said combustion air duct to said lowest and second lowest fluidizing vessels of said incipient calcination furnace.

11. A preheating system as set forth in claim 2, wherein said course dust feed port is located at a position close to said fuel feeder and said fine dust feed port is located at a position remote from said fuel feeder.

12. A preheating system as set forth in claim 2, wherein said coarse dust feed port is located upstream of said fine dust feed port as seen in a flow direction of gases in said incipient calcination furnace.

* * * * *